US005184750A

United States Patent [19]

Moller

[11] Patent Number: 5,184,750

[45] Date of Patent: Feb. 9, 1993

[54] PARTY DISH

[76] Inventor: B. Weems Moller, P.O. Box 688, Kerrville, Tex. 78029

[21] Appl. No.: 745,770

[22] Filed: Aug. 16, 1991

[51] Int. Cl.[5] ..... B65D 21/02; B65D 1/36

[52] U.S. Cl. ..... 220/575; 220/23.83; 220/556; 206/562; 206/564

[58] Field of Search ..... 99/DIG. 15; 206/562, 206/564; 220/23.83, 23.8, 23.86, 556, 575; D7/602, 619, 616

[56] References Cited

U.S. PATENT DOCUMENTS

| | | | |
|---|---|---|---|
| 421,264 | 2/1890 | Gibbons | 220/575 |
| 2,207,417 | 7/1940 | Smith | 220/575 |
| 2,766,919 | 10/1956 | Randall | 206/562 |
| 3,376,974 | 4/1968 | Hilliard | 206/562 |
| 3,955,672 | 5/1976 | Brundage | 206/562 |
| 4,219,144 | 8/1980 | Hagelberg | 206/564 |
| 4,461,396 | 7/1984 | Harper | 220/23.83 |
| 4,516,685 | 5/1985 | French | 220/23.83 |
| 4,607,758 | 8/1986 | Stevens | 220/23.83 |
| 4,867,331 | 9/1989 | Task | 206/564 |
| 4,989,742 | 2/1991 | Powell | 220/737 |
| 5,085,391 | 2/1992 | Berger et al. | 220/23.83 |

FOREIGN PATENT DOCUMENTS

| | | | |
|---|---|---|---|
| 398273 | 11/1990 | European Pat. Off. | 220/556 |
| 1471281 | 3/1967 | France | 220/575 |
| 2297023 | 8/1976 | France | 220/23.83 |
| 15022 | of 1900 | United Kingdom | 220/23.83 |
| 2078493 | 1/1982 | United Kingdom | 206/564 |
| 2154428 | 9/1985 | United Kingdom | 206/564 |

*Primary Examiner*—Allan N. Shoap
*Assistant Examiner*—S. Castellano
*Attorney, Agent, or Firm*—G. Turner Moller

[57] ABSTRACT

A party dish includes a generally circular food receiving section and a cup supporting member comprising an extension from the food receiving section. The dish can be held in one hand thereby freeing the other hand for eating off the dish or drinking from the cup. The dish is made from a generally square stock of material having a side substantially equal to the diameter of the food receiving section.

9 Claims, 1 Drawing Sheet

PARTY DISH

This invention relates to a dish, preferably disposable, which is configured to hold food and a cup and which can be held in one hand by the user.

Most people have attended a stand up party where food and drink are served. With one hand to hold a dish and one hand to hold a cup or glass, one more hand is needed to eat off the dish. Attempts have been made to alleviate this problem by providing a dish with an opening or recess to support the cup as shown in U.S. Pat. Nos. 3,955,672; 4,516,685 and 4,744,597. The broad idea is to free up one hand so the user can take food off the dish. A similar approach is found in U.S. Pat. Nos. 3,401,858 and 4,461,396. Disclosures of more general interest are found in U.S. Pat. Nos. RE13,825; 2,295,860; 3,883,029 and 4,732,274.

There are manifest disadvantages with each of the approaches of the prior art. In several of these approaches, the cup extends through an opening in the dish, the dish rests on the user's left arm, for example, and the user grasps the cup with the left hand to stabilize the dish. This is not satisfactory when the user wants to remove the cup from its opening because the dish becomes unstable if it is simply resting on the user's arm. In those devices which are intended to be held in one hand, none of the prior art devices are apparently designed to be grasped so the cup is partially counterbalanced by food on the dish. In addition, many of the prior art devices are not designed with a view to minimizing costs, which is somewhat surprising because minimal costs are crucial for dishes of the type used as party plates, particularly if they are disposable.

In a reusable version, the dish of this invention is conveniently made by vacuum forming a thick plastic sheet. In a disposable version, the dish is made of a thinner plastic sheet, pressed paper or the like. The dish is formed from a flat sheet of stock and is designed to provide a large generally circular food holding area and an extension from the food holding circle comprising a cup supporting member in which a cup receiving opening is provided. In the preferred embodiment, the extension is arranged to fit in a corner of a square having a side the same as the circle diameter so there is no more material requirement than if the dish were completely circular and the cup section intrudes into less than 10% of the food receiving area. Thus, the dish of this invention is no more expensive to manufacture than a simple circular dish not having the cup holding ability and user grasping characteristics of this invention. In addition, the dishes of this invention can fit in a cabinet where it will occupy no more space than a round dish and be packed in a square carton having sides only slightly larger than the diameter of the food holding circle because the cup extension fits in a corner of the carton or cabinet. After vacuum forming, the dish of this invention can be finished-trimmed with one vertical strike. No other dish, designed to be held by one hand and adapted to receive a cup, can use this quick finishing and expense saving feature in manufacturing.

One object of this invention is to provide an improved party dish capable of holding food and a cup and capable of being held easily by one hand.

Another object of this invention is to provide an improved party dish having the capacity to hold food and a cup and being inexpensive to manufacture.

These and other objects of this invention will become more fully apparent as this description proceeds, reference being made to the accompanying drawing and appended claims.

IN THE DRAWINGS

Figure 1:
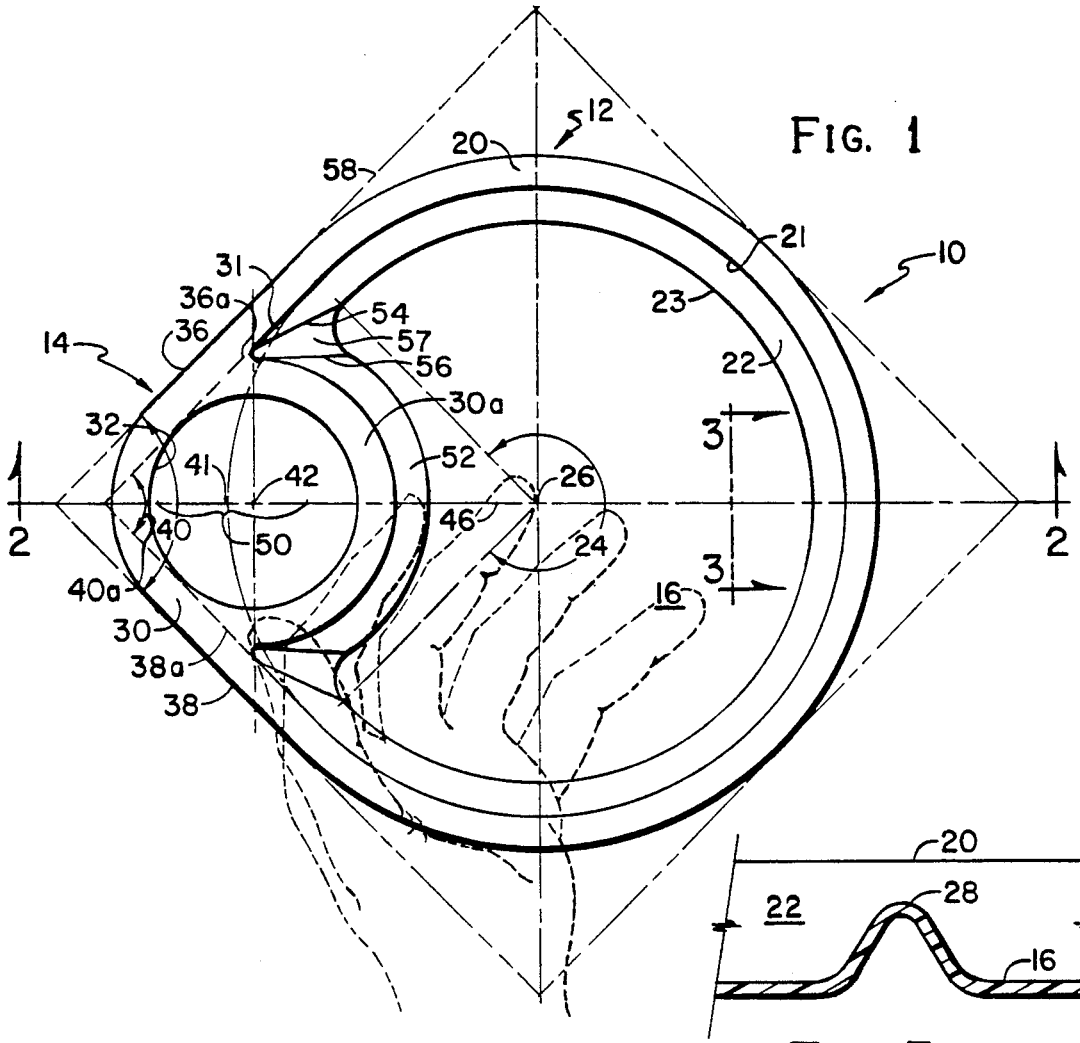
FIG. 1 is a top plan view of the dish of this invention.
Figure 2:
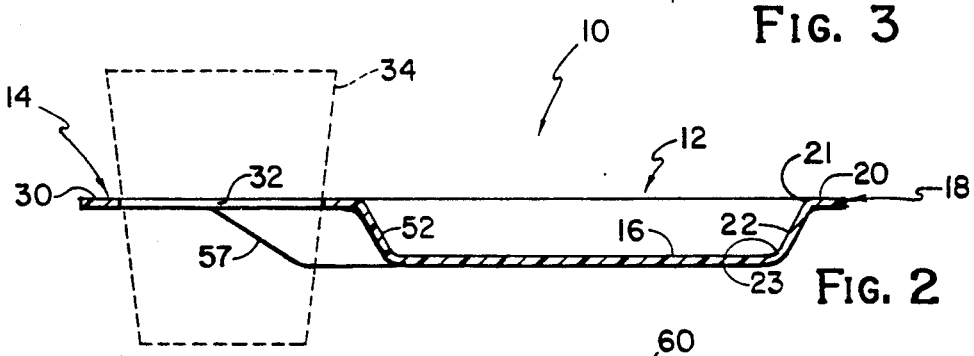
FIG. 2 is a cross-sectional view of the dish of FIG. 1, taken substantially along line 2—2, as viewed in the direction indicated by the arrows.

Referring to FIGS. 1-2, a party dish 10 of this invention includes a food receiving section 12 and a cup supporting section or member 14. The food receiving section 12 provides a food receiving well including a flat bottom wall 16 and a raised lip 18 comprising a horizontal flange 20 and an inclined wall 22 making the transition between the flange 20 and the bottom wall 16 along arcuate upper and lower edges 21, 23. The food receiving section 12 is substantially circular in an arc 24 in the range of 180–290° about a center 26 and, in a preferred embodiment of the invention, the arc 24 is about 270°.

Figure 3:
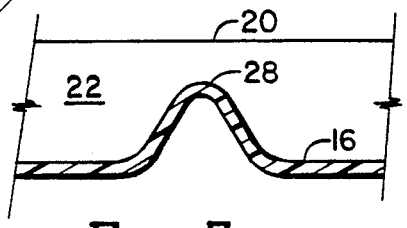
FIG. 3 is a cross-sectional view of another embodiment of this invention, viewed as if taken along line 3—3 of FIG. 1 as viewed in the direction indicated by the arrows.

As shown in FIG. 3, the bottom wall 16 may be divided by one or more partitions 28 extending across the food receiving section 12 to provide separate compartments for food in the section 12 and to provide considerably greater rigidity.

The cup supporting section 14 is an extension from the food section 12 and includes a flange 30 merging with the coplanar flange 20. In the alternative, a flange section **30*a* may lie in a plane between the flange 20 and the plate bottom 16. An opening 32 through the flange 30 receives a tapered cup 34. Because the cup 34 extends through the opening 32, the center of gravity is quite low and there is no danger of tipping the cup over into the section 12. When the user sits the dish 10 on a table, the cup 34 is separately supported on the table and the dish 10 slips downwardly over the cup 34 onto the table but the cup 34 remains in the opening 32 because the flange 30 is above the bottom wall 16 on which the dish 10 rests. The flange 30 includes sides 36, 38 generally tangential to the food receiving section 12 and defining an angle 40 therebetween. The sides 36, 38 are preferably straight or, if curved, the tangents or average directions define the angle 40. The angle 40 is in the range of 60–120° and is preferably about 90°. an angle 40*a* is defined by lines 36*a*, 38*a* which are tangent to the circles provided by the opening 32 and the edge 21. In the embodiment of FIG. 1, the angles 40, 40*a* are the same size, although the angles 40, 40*a*** may differ in other configurations.

On reflection, it will be seen that there is a relationship between the size of the party dish 10 and the size of the cup opening 32. In one particular model, the party dish is 9 inches in diameter and the cup opening is $2\frac{3}{8}$ inches in diameter. This is a rather large sounding ratio of 26% but, in reality, the relationship is just about right. The ratio of the diameters will almost always be 20–35% for normal sized plates because the cup opening 32 has to be a certain minimum size. The cup opening 32 is normally circular having a center 42.

Thus, the cup supporting member 14 is on an extension from the circular arrangement of the food receiving section 12 so the cup opening 32 intersects a circle 31 defined by the center 26 and an inner diameter provided by the edge 21 of the plate flange 20. This can also be described as the second inner diameter of the inner circle circumscribing the food receiving section 12. Thus the circle 31 has, as its major component, the circle of the food receiving section 12. A dish centerline 46 is defined by the centers 26, 42 and the circle 31 intersects the center line 46 at a point 41. The center 42 of the cup opening 32 lies in a zone 50 between a first point spaced about three fourths of the radius of the cup opening 32 from the intersection 41 toward the center 26 and a second point spaced less than about three fourths of the radius of the cup opening 32 from the intersection 41, away from the center 26.

There is obviously a transition between the horizontal flange 30*a* and the bottom wall 16 of the food section 12. To this end, an inclined wall segment 52 extends between the bottom wall 16 and the flange 30*a* and has a generally circular curvature about the cup opening center 42. The inclined walls 22, 52 merge along lines 54, 56 and form inclined valleys 57 which extend from the flange 30*a* to the plate bottom wall 16. The inclined valleys 57 look like gussets from the side (FIG. 2) and also act like gussets, strengthening the junction between the food section 12 and the cup section 14.

In the preferred embodiment of FIG. 1, the party dish 10 is struck from a square stock of material 58 or is trimmed to have a side the same dimension as the diameter of the food receiving section 12. The party dish 10 accordingly fits into a square carton having a side the same dimension as the diameter of the food receiving section 12. Thus, the geometry of the party dish 10 provides a maximum combined food and cup area, maximum strength and with a minimum of material and a minimum of storage and transportation requirements.

Figure 4:
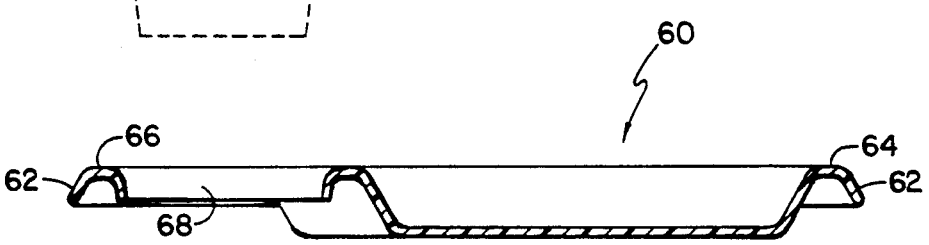
FIG. 4 is a cross-sectional view, similar to FIG. 2, of a dish of somewhat different construction.

Referring to FIG. 4, another party dish 60 of this invention is illustrated. The dish 60 is identical to the dish 10 except for the provision of a downturned edge 62 on the horizontal flanges 64, 66 and a downturned edge 68 providing the cup opening. These downturned edges provide greater strength and allow the use of thinner plastic sheet stock which is particularly important in the manufacture of inexpensive disposable dishes by vacuum forming.

Use of the dishes 10, 60 of this invention should now be apparent. A right handed user typically grasps the dish with the left hand by placing the left thumb on the upper side of the flange 20 near the valley 57, as shown in phantom lines in FIG. 1. The exact position of the left thumb is variable. Most people prefer to place the thumb as shown in FIG. 1 but some prefer to place it on the flange 20 further away from the valley 57. The fingers of the user extend under the bottom wall 16 near the underside of the inclined wall 52. The dish 10 is relatively balanced when holding food and/or the cup 34. The right hand is free to retrieve the cup 34 or food. Because the dishes 10, 60 are symmetrical about the centerline 46, left handed users grasp the dishes 10, 60 without awkwardness in a mirror image fashion.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A party dish capable of being held by one hand of a user, comprising a body having a food receiving section generally circular for a first predetermined arc about a center axis and having a first outer diameter, a second inner diameter providing a second circular arc circumscribing the food receiving section, and a cup receiving section comprising an extension on one side of the food receiving section, the cup receiving section providing first and second sides generally tangential to the food receiving section and defining therebetween an angle in the range of 60–120°;

the food receiving section providing a bottom wall, a first upper flange generally parallel to the bottom wall defining the second circular arc in the range of about 180–290° and an inclined side wall connecting the bottom wall and the first upper flange and defining upper and lower arcuate transition edges providing the second circular arc and a third circular arc;

the cup receiving section having a second upper annular flange providing a generally circular opening therethrough for receiving a cup and having a center and a radius, the first and second flanges merging on opposite sides of the cup receiving section; and an imaginary centerline of the dish extending through the center of the food receiving section and the center of the cup receiving opening;

a circle of the second diameter having a center at the center axis, the circle of the second diameter extending through the cup receiving opening and intersecting the centerline;

the center of the cup opening lying in a zone between a first point on the centerline spaced about three fourths of the radius of the cup opening from the second diameter circle-centerline intersection, toward the food section, and a second point spaced less than about three fourths of the radius of the cup opening from the second diameter circle-centerline intersection away from the food receiving section;

the food receiving section provides a bottom wall and the cup receiving section and the food receiving section meet in a corner defining an acute angle and further comprising a first transition wall merging between the first upper flange and the bottom wall, a second transition wall merging between the second upper flange and the bottom wall, the first and second transition walls meeting in the corner in an inclined valley extending from adjacent the first upper flange to the bottom wall, the inclined valley tapering from a narrow upper end adjacent the first upper flange to a wide lower end adjacent the bottom wall.

2. The party dish of claim 1 wherein the angle is in the range of 70–110°.

3. The party dish of claim 2 wherein the angle is about 90°.

4. The party dish of claim 1 wherein the first and second flanges are coplanar in a plane above the food receiving section bottom wall.

5. The party dish of claim 4 wherein the first and second flanges comprise an outer edge downturned from the plane.

6. The party dish of claim 1 wherein the predetermined arc of the food receiving section is in the range of 180-290°.

7. The party dish of claim 6 wherein the predetermined arc of the food receiving section is about 270°.

8. The party dish of claim 1 wherein the food receiving section provides at least one ridge dividing the food receiving section into a plurality of compartments.

9. The party dish of claim 1 wherein the cup receiving section comprises a downturned edge providing the cup receiving opening.

* * * * *